US012686420B2

(12) United States Patent
Shoup et al.

(10) Patent No.: US 12,686,420 B2
(45) Date of Patent: Jul. 21, 2026

(54) EXTENDED TRAVEL RAILCAR DAMPING SYSTEM

(71) Applicant: A. Stucki Company, Moon Township, PA (US)

(72) Inventors: Joseph Michael Shoup, Imperial, PA (US); James Scott Kennedy, Zelienople, PA (US); Neil Aaron Brant, Oakdale, PA (US)

(73) Assignee: A. Stucki Company, Moon Township, PA (US)

( * ) Notice: Subject to any disclaimer, the term of this patent is extended or adjusted under 35 U.S.C. 154(b) by 988 days.

(21) Appl. No.: 17/833,943

(22) Filed: Jun. 7, 2022

(65) Prior Publication Data

US 2023/0391381 A1 Dec. 7, 2023

(51) Int. Cl.
*B61G 9/10* (2006.01)

(52) U.S. Cl.
CPC ..... *B61G 9/10* (2013.01)

(58) Field of Classification Search
CPC ... B61G 9/10; B61G 9/06; B61G 9/22; B61G 9/14
USPC ..... 213/32 C, 32 R, 33, 22, 24, 31
See application file for complete search history.

(56) References Cited

U.S. PATENT DOCUMENTS 2,686,667 A 8/1954 Willison et al.
3,178,036 A 4/1965 Cardwell
3,741,406 A 6/1973 Anderson
4,305,514 A 12/1981 Zanow et al.
4,645,187 A * 2/1987 Kanjo ..... B61G 9/18 267/209
4,735,328 A * 4/1988 Carlstedt ..... B61G 9/10 213/32 R
5,152,409 A * 10/1992 Sommerfeld ..... B61G 9/10 213/32 C
5,443,170 A * 8/1995 Merker, Jr. ..... B61G 9/10 213/38
5,452,814 A * 9/1995 Merker, Jr. ..... B61G 9/10 213/32 C
6,446,820 B1 * 9/2002 Barker ..... B61G 9/22 213/46 R
6,478,173 B2 * 11/2002 Carlstedt ..... B61G 11/14 213/32 C
6,488,162 B1 * 12/2002 Carlstedt ..... B61G 9/10 213/32 R
6,923,331 B2 * 8/2005 Sommerfeld ..... B61G 9/08 213/41

(Continued)

OTHER PUBLICATIONS

International Search Report for PCT/US2023/24240 dated Aug. 25, 2023.

(Continued)

*Primary Examiner* — Zachary L Kuhfuss
(74) *Attorney, Agent, or Firm* — Buchanan Ingersoll & Rooney PC

(57) ABSTRACT

Embodiments relate to a damping system, and in particular a clutch mechanism for an extended travel draft gear having components arranged such that movement of clutch mechanism components transforms kinetic energy into thermal energy via friction, while allowing for an extended length of travel. An arrangement of clutch component geometries, lengths, angles, etc. allows for motion along a longitudinal axis of the clutch mechanism to be damped via energy dissipation.

11 Claims, 10 Drawing Sheets

(56) References Cited

U.S. PATENT DOCUMENTS

| | | | | |
|---|---|---|---|---|
| 7,264,130 | B2 * | 9/2007 | Sommerfeld | B61G 9/22 213/31 |
| 7,311,215 | B2 * | 12/2007 | Sommerfeld | B61G 9/08 213/41 |
| 7,419,065 | B2 * | 9/2008 | Sommerfeld | B61G 9/10 213/32 C |
| 8,096,432 | B2 * | 1/2012 | Sprainis | B61G 9/22 213/40 R |
| 8,672,151 | B2 * | 3/2014 | Sprainis | B61G 9/06 213/32 C |
| 2005/0155947 | A1 * | 7/2005 | Sommerfeld | B61G 9/22 213/75 R |
| 2005/0252874 | A1 * | 11/2005 | King | B61G 9/10 213/7 |
| 2007/0205174 | A1 * | 9/2007 | Sommerfeld | B61G 9/10 213/31 |
| 2008/0264890 | A1 * | 10/2008 | King | B61G 9/18 213/33 |
| 2009/0308829 | A1 * | 12/2009 | Sprainis | B21F 35/00 213/32 C |
| 2015/0014267 | A1 * | 1/2015 | Creighton | B61F 1/10 213/65 |
| 2021/0284205 | A1 * | 9/2021 | Aleynikov | B61G 9/10 |

OTHER PUBLICATIONS

Written Opinion of the International Searching Authority for PCT/US2023/24240 dated Aug. 25, 2023.

* cited by examiner

EXTENDED TRAVEL RAILCAR DAMPING SYSTEM

FIELD OF THE INVENTION

Embodiments relate to a railcar damping system having a clutch mechanism configured to transform kinetic energy into thermal energy via friction to damp motion, while allowing for an extended length of travel. More particularly, movement of clutch mechanism components along the longitudinal axis of the clutch mechanism is damped via energy dissipation.

BACKGROUND OF THE INVENTION

A railcar damping system is a device that is positioned at or near an end of a railcar and is in mechanical connection with the railcar's coupler. When it is desired to couple a railcar to another railcar, one of the railcars is advanced towards the other to generate an impact coupling event—two couplers connect to each other to join the two railcars together. The damping system absorbs and controllably dissipates energy of the impact so as to reduce or eliminate damage to the railcars. The damping system also dissipates energy during railcar oscillations otherwise known as in-train forces, which occur due to the pushing and pulling of individual railcars as it is moving along in the train consist. Conventional railcar damping systems provide means to absorb/dissipate energy, yet they generally rely on standard travel gears, hydraulic damping, and other designs that tend to either have limited distance of travel or poor performance in regards to dissipating in-train forces. Conventional systems can be appreciated, for example, from U.S. Pat. Nos. 3,741,406 and 3,178,036.

The present disclosure is directed toward overcoming one or more of the above-mentioned problems, though not necessarily limited to embodiments that do.

SUMMARY OF THE INVENTION

Embodiments relate to a damping system, and in particular a clutch mechanism for a draft gear having components arranged such that movement of clutch mechanism components transforms kinetic energy into thermal energy via friction. Arrangement of clutch component geometries, lengths, angles, etc. allows for motion along the longitudinal axis of the clutch mechanism to be damped via energy dissipation.

Embodiments disclosed herein may be referred to as an extended travel draft gear. The extended travel draft gear is an energy dissipation device for railcars that can easily replace traditional draft gears or hydraulic cushioning units (AKA end-of-car cushioning units). The extended travel draft gear uses a friction clutch mechanism and a set of traditional springs or elastomeric springs to provide greater than 5 inches of travel, whereas a conventional draft gear only provides 3.25 inches of travel. Embodiments of the extended travel draft gear use at least seven components in the clutch mechanism including moveable plates. As will be shown herein, the moveable plates have extended lengths to allow for 5-9 inches of movement before the housing of the draft gear interferes with movement of clutch components. Longer travel (e.g., 5-9 inches) reduces railcar acceleration compared to a shorter travel (3.25 inches) of conventional draft gears. Lower acceleration values are important to protecting the railcar lading.

In addition, the number of clutch mechanism components and geometries (e.g., length, shape, angles, etc.) of the clutch mechanism components allow for more energy dissipation via friction than what would normally be achieved with conventional systems.

Another beneficial aspect of the extended travel draft gear is that the recoil, or amount of energy that is returned back into the system, is minimal. While energy dissipation occurs via spring/elastomer components of the draft gear, the extended travel draft gear maximizes the amount of energy that is dissipated through the clutch mechanism of the draft gear, leading to minimal recoil.

Embodiments of the Extended Travel Draft Gear Provide the Following:

- A draft gear with a friction clutch and set of traditional springs or elastomeric springs that has greater than 5 inches of travel.
- A draft gear with a friction clutch and set of traditional springs or elastomeric springs that has greater than 5 inches of travel with at least 7 friction clutch components.
- A draft gear with a friction clutch and set of traditional springs or elastomeric springs that has greater than 5 inches of travel and has a recoil value of less than 15% at capacities greater than 20,000 ft-lbs. Capacity is the amount of energy input into the damping system. Recoil is the amount of energy that is not dissipated by the draft gear and is returned back into the railcar system.
- A draft gear with a friction clutch and set of traditional springs or elastomeric springs that has greater than 5 inches of travel and withstands 60,000-80,000 ft-lbs of energy imparted on the gear while not exceeding a reaction force of 600,000 lbs over a range of the center wedge moving 3-4 inches.
- A draft gear with a friction clutch and set of traditional springs or elastomeric springs that has greater than 5 inches of travel and withstands 120,000-150,000 ft-lbs of energy imparted on the gear while not exceeding a reaction force of 1,000,000 lbs over a range of the center wedge moving 6.5-7 inches.

The following performance aspects can be achieved via the inventive extended travel draft gear:

- Draft Gear that fits into a pocket 38-50 inches and fits in most AAR End of Car Cushioning pockets including EOC-8, EOC-9, and EOC-10.
- Draft gear with increased buff travel capable of fitting into EOC pockets.
- Damping system provides more cushioning than traditional draft gears.
- Uses one clutch assembly to achieve travel of 5-10 inches of gear travel.
- Achieves performance close to EOC units without using hydraulic cylinders.

In an exemplary embodiment, the extended travel draft gear includes a metal housing with an open end and closed end. A series of friction members are positioned in the open end of the housing. The wedge-shaped friction member in the middle of the assembly forms a center wedge. The center wedge has two friction surfaces that are orientated at 60-degrees from a longitudinal axis of the draft gear. In a railcar, the follower block compresses the center wedge in both buff and draft directions of draft gear motion. As the center wedge is compressed downward towards the closed end of the housing, it slides on two friction shoes pushing them downward towards the closed end of the housing as well as inward towards the centerline of the gear. In the uncompressed state, or free height of the gear, the top of the center wedge is approximately 7 inches from the open end of the housing. When the draft gear is fully compressed, the top of the center wedge is flush with the open end of the housing.

The friction shoe is generally rectangular with sloped friction surfaces on the top, bottom, and back of the part. The top friction surface that mates with the center wedge friction surface is orientated at 60-degrees from a longitudinal axis of the draft gear. When the draft gear is in the free height position, the top edge of the friction shoe is approximately 3.39" from the centerline of the gear. The bottom sloped surface of the friction shoe contacts the friction surface of the spring seat and is orientated at 115-degrees from a longitudinal axis of the draft gear. At the free height position, the bottom corner of the friction shoe is approximately 2.90" from the centerline of the gear and the top of the shoe is approximately 2.81" above the open end of the housing. The back surface of the friction shoe slides along the tapered plate and is orientated at 3-degrees from a longitudinal axis of the draft gear. As the friction shoe is pushed downward and inward by the center wedge, friction is produced by the friction shoe sliding relative the center wedge, tapered plate, and spring seat. When the draft gear is fully compressed the top corner of the shoe is approximately 3.01" from the center line and is approximately 4.41" below the opening of the housing. The bottom corner of the shoe is approximately 2.52" from the centerline.

The tapered plate is generally rectangular with a sloped friction surface on the one side and a straight friction surface on the opposite side. It has a 3-degree sloped surface that mates with friction shoe. The opposite face is vertical and interacts with the moveable plate. The tapered plate sits on a shelf inside the housing and remains stationary. Friction is produced on the tapered plate by the friction shoe and moveable plate sliding relative to it.

The moveable plate is a rectangular part that is compressed by the follower block once the center wedge is compressed after a predetermined amount of travel. At free height of the gear, the moveable plates are approximately 0.37" below the top surface of the center wedge. At free height, the moveable plates contact the outer section of the spring seat. Friction is produced on the moveable plate on both sides as it slides relative to the tapered plate and outer stationary plate. As the gear is compressed, the friction shoes compress the spring seat more and separation occurs between the moveable plates and spring seat. At gear solid height there is an approximately 0.79" gap between the moveable plates and spring seat.

The outer stationary plate is a rectangular part that sits on a shelf on the housing and against the outer wall of the housing and remains stationary. Friction is produced as the moveable plate moves relative to it.

The spring seat is a T shaped part with sloped surfaces on the top to mate with friction shoes orientated at approximately 115-degrees from a longitudinal axis of the draft gear. The outer sections contact the moveable plates at free height. Below the spring seat, sits an elastomeric spring pad stack. At free height the top of the spring seat is approximately 5.62" below the open end of the housing. At solid height the top of the spring seat is approximately 13.01" below the open end of the housing.

The elastomer pad stack sits below the spring seat and is comprised of elastomer pads and metal shim plates in between each pad. As the gear is compressed, the spring seat presses downward on the elastomer pad stack. At free height the top of the elastomer pad stack is approximately 18.51 from the closed end of the housing and at solid height it is approximately 11.11".

Gear travel is characterized by the distance the follower block is compressing parts in the gear. This extended travel gear is able to travel approximately 7" while standard draft gears typically travel between approximately 3.25" and 3.50". The friction components in the extended travel gear slide over twice the distance as those in a conventional draft gear. The increased travel that the components slide and the amount of energy that is dissipated through friction in the extended travel gear gives it superior performance to a conventional draft gear. The extended travel draft gear is able to dissipate a significant amount more energy than a conventional draft gear at a similar reaction force. Since the draft gear has more travel, the accelerations are also lower than a conventional draft gear. The increased energy dissipation and lower accelerations of the extended travel gear protects the railcar structure and lading against higher impacts and in-train forces.

An exemplary embodiment includes a clutch mechanism for a railcar draft gear. The clutch mechanism includes a center wedge having a wedge front end and a wedge rear end with a longitudinal axis running from the wedge front end to the wedge rear end, the wedge front end configured to mechanically engage a coupler, the wedge rear end configured to mechanically engage a friction shoe assembly, the wedge rear end having a first wedge rear surface that makes a 55-65° angle relative to the longitudinal axis and a second wedge rear surface that makes a 55-65° angle relative to the longitudinal axis. The clutch mechanism includes the friction shoe assembly and the friction shoe assembly includes a first shoe configured to mechanically engage the first wedge rear surface and a second shoe configured to mechanically engage the second wedge rear surface. The first shoe has a front shoe surface, a rear shoe surface, and a side shoe surface, the front shoe surface making a 55-65° angle relative to the longitudinal axis and is configured to mechanically engage the first wedge rear surface, the rear shoe surface making a 110-120° angle relative to the longitudinal axis and is configured to mechanically engage with a spring seat, the side shoe surface making a 2-5° angle relative to the longitudinal axis and is configured to mechanically engage with a tapered plate assembly. The second shoe has a front shoe surface, a rear shoe surface, and a side shoe surface, the front shoe surface making a 55-65° angle relative to the longitudinal axis and is configured to mechanically engage the second wedge rear surface, the rear shoe surface making a 110-120° angle relative to the longitudinal axis and is configured to mechanically engage with a spring seat, the side shoe surface making a 2-5° angle relative to the longitudinal axis and is configured to mechanically engage with the tapered plate assembly. The clutch mechanism includes the spring seat. The spring seat has a seat front end and a seat rear end, the seat front end having a first seat front surface configured to mechanically engage the rear shoe surface of the first shoe and a second front seat surface configured to mechanical mechanically engage the rear shoe surface of the second shoe. The clutch mechanism includes the tapered plate assembly. The tapered plate assembly includes a first tapered plate having a tapered plate front end and a tapered plate rear end defining a length of 6-10 inches, the first tapered plate having a straight side and a tapered side, the tapered side configured to mechanically engage the side shoe surface of the first shoe. The tapered plate assembly includes a second tapered plate having a tapered plate front end and a tapered plate rear end defining a length of 6-10 inches, the second tapered plate having a straight side and a tapered side, the tapered side configured to mechanically engage the side shoe surface of the second shoe. The clutch mechanism includes a moveable plate assembly. The moveable plate assembly includes a first moveable plate having a moveable plate front end and a moveable plate rear end defining a length of 12-18 inches, the first moveable plate having a moveable plate inner side and a moveable plate outer side, the moveable plate inner side configured to mechanically engage the straight side of the first tapered plate. The moveable plate assembly includes a second moveable plate having a moveable plate front end and a moveable plate rear end defining a length of 12-18 inches, the second moveable plate having a moveable plate inner side and a moveable plate outer side, the moveable plate inner side configured to mechanically engage the straight side of the second tapered plate. The clutch mechanism includes an outer plate assembly. The outer plate assembly includes a first outer plate having an outer plate front end and an outer plate rear end defining a length of 5.25-10 inches, the first outer plate having an outer plate inner side and an outer plate outer side, the outer plate inner side configured to mechanically engage the moveable plate outer side of the first moveable plate. The outer plate assembly includes a second outer plate having an outer plate front end and an outer plate rear end defining a length of 5.25-10 inches, the second outer plate having an outer plate inner side and an outer plate outer side, the outer plate inner side configured to mechanically engage the moveable plate outer side of the second moveable plate.

In some embodiments, the clutch mechanism includes a housing configured to hold both the tapered plate assembly and the outer plate assembly stationary relative to the housing.

In some embodiments, the housing has a housing front end and a housing rear end. The clutch mechanism is configured to transition between a fully compressed state and a fully uncompressed state. In the fully compressed state, each moveable plate front end is flush with the housing front end. In the fully uncompressed state, each moveable plate front end extends 5-8 inches beyond the housing front end.

In some embodiments, during transitioning from the fully uncompressed state towards a fully compressed state: the center wedge engages the friction shoe assembly; the friction shoe assembly engages the spring seat and the tapered plate assembly; the moveable plate assembly engages the tapered plate assembly and the outer plate assembly; and movement of the center wedge, the friction shoe assembly, and the moveable plate assembly relative to the tapered plate assembly and the outer plate assembly transforms kinetic energy into thermal energy via friction, wherein motion along the longitudinal axis is damped via energy dissipation.

An exemplary embodiment relates to a railcar draft gear. The railcar draft gear includes a housing having an open housing front end and a closed housing rear end. The railcar draft gear a clutch mechanism located within the housing front end. The clutch mechanism includes a center wedge having a wedge front end and a wedge rear end with a longitudinal axis running from the wedge front end to the wedge rear end, the wedge front end configured to mechanically engage a coupler, the wedge rear end configured to mechanically engage a friction shoe assembly, the wedge rear end having a first wedge rear surface that makes a 55-65° angle relative to the longitudinal axis and a second wedge rear surface that makes a 55-65° angle relative to the longitudinal axis. The clutch mechanism includes the friction shoe assembly, comprising a first shoe configured to mechanically engage the first wedge rear surface and a second shoe configured to mechanically engage the second wedge rear surface. The first shoe has a front shoe surface, a rear shoe surface, and a side shoe surface, the front shoe surface making a 55-65° angle relative to the longitudinal axis and is configured to mechanically engage the first wedge rear surface, the rear shoe surface making a 55-65° angle relative to the longitudinal axis and is configured to mechanically engage with a spring seat, the side shoe surface making a 2-5° angle relative to the longitudinal axis and is configured to mechanically engage with a tapered plate assembly. The second shoe has a front shoe surface, a rear shoe surface, and a side shoe surface, the front shoe surface making a 55-65° angle relative to the longitudinal axis and is configured to mechanically engage the second wedge rear surface, the rear shoe surface making a 110-120° angle relative to the longitudinal axis and is configured to mechanically engage with a spring seat, the side shoe surface making a 2-5° angle relative to the longitudinal axis and is configured to mechanically engage with the tapered plate assembly. The clutch mechanism includes the spring seat having a seat front end and a seat rear end, the seat front end having a first seat front surface configured to mechanically engage the rear shoe surface of the first shoe and a second front seat surface configured to mechanically engage the rear shoe surface of the second shoe, the seat rear end configured to mechanically engage an elastomer pad assembly. The clutch mechanism includes the tapered plate assembly. The tapered plate assembly includes a first tapered plate having a tapered plate front end and a tapered plate rear end defining a length of 6-10 inches, the first tapered plate having a straight side and a tapered side, the tapered side configured to mechanically engage the side shoe surface of the first shoe; and a second tapered plate having a tapered plate front end and a tapered plate rear end defining a length of 6-10 inches, the second tapered plate having a straight side and a tapered side, the tapered side configured to mechanically engage the side shoe surface of the second shoe. The clutch mechanism includes a moveable plate assembly. The moveable plate assembly includes a first moveable plate having a moveable plate front end and a moveable plate rear end defining a length of 12-18 inches, the first moveable plate having a moveable plate inner side and a moveable plate outer side, the moveable plate inner side configured to mechanically engage the straight side of the first tapered plate; and a second moveable plate having a moveable plate front end and a moveable plate rear end defining a length of 12-18 inches, the second moveable plate having a moveable plate inner side and a moveable plate outer side, the moveable plate inner side configured to mechanically engage the straight side of the second tapered plate. The clutch mechanism includes an outer plate assembly. The outer plate assembly includes: a first outer plate having an outer plate front end and an outer plate rear end defining a length of 5.25-10 inches, the first outer plate having an outer plate inner side and an outer plate outer side, the outer plate inner side configured to mechanically engage the moveable plate outer side of the first moveable plate; and a second outer plate having an outer plate front end and an outer plate rear end defining a length of 5.25-10 inches, the second outer plate having an outer plate inner side and an outer plate outer side, the outer plate inner side configured to mechanically engage the moveable plate outer side of the second moveable plate. The clutch mechanism includes the elastomer pad assembly, comprising a plurality of elastomer pads arranged within the housing rear end.

In some embodiments, the tapered plate assembly and the outer plate assembly are secured to the housing such that each is held stationary relative to the housing.

In some embodiments, the draft gear is configured to transition between a fully compressed state and a fully uncompressed state; in the fully compressed state, each moveable plate front end is flush with the housing front end; and in the fully uncompressed state, each moveable plate front end extends 5-8 inches beyond the housing front end.

In some embodiments, during transitioning from the fully uncompressed state towards a fully compressed state: the center wedge engages the friction shoe assembly; the friction shoe assembly engages the spring seat and the tapered plate assembly; the moveable plate assembly engages the tapered plate assembly and the outer plate assembly; and movement of the center wedge, the friction shoe assembly, and the moveable plate assembly relative to the tapered plate assembly and the outer plate assembly transforms kinetic energy into thermal energy via friction, wherein motion along the longitudinal axis is damped via energy dissipation.

In some embodiments, during transitioning from the fully uncompressed state towards a fully compressed state, the seat rear end mechanically engages the elastomer pad assembly to cause the elastomer pad assembly to compress.

In some embodiments, the elastomer pad assembly includes a pad shim disposed between two elastomer pads.

An exemplary embodiment relates to a method of damping motion within a railcar draft gear comprising a center wedge, a friction shoe assembly, a moveable plate assembly, a tapered plate assembly, an outer plate assembly, a spring seat, and an elastomer pad assembly. The method involves allowing movement of the center wedge, the friction shoe assembly, and the moveable plate assembly relative to the tapered plate assembly and the outer plate assembly to transform kinetic energy into thermal energy via friction such that motion along a longitudinal axis of the railcar draft gear is damped via energy dissipation by 5-9 inches of movement.

Further features, aspects, objects, advantages, and possible applications of the present invention will become apparent from a study of the exemplary embodiments and examples described below, in combination with the Figures, and the appended claims.

BRIEF DESCRIPTION OF THE DRAWINGS

The above and other objects, aspects, features, advantages and possible applications of the present innovation will be more apparent from the following more particular description thereof, presented in conjunction with the following drawings. Like reference numbers used in the drawings may identify like components.

DETAILED DESCRIPTION OF THE INVENTION

The following description is of exemplary embodiments that are presently contemplated for carrying out the present invention. This description is not to be taken in a limiting sense, but is made merely for the purpose of describing the general principles and features of various aspects of the present invention. The scope of the present invention is not limited by this description.

Figure 1:
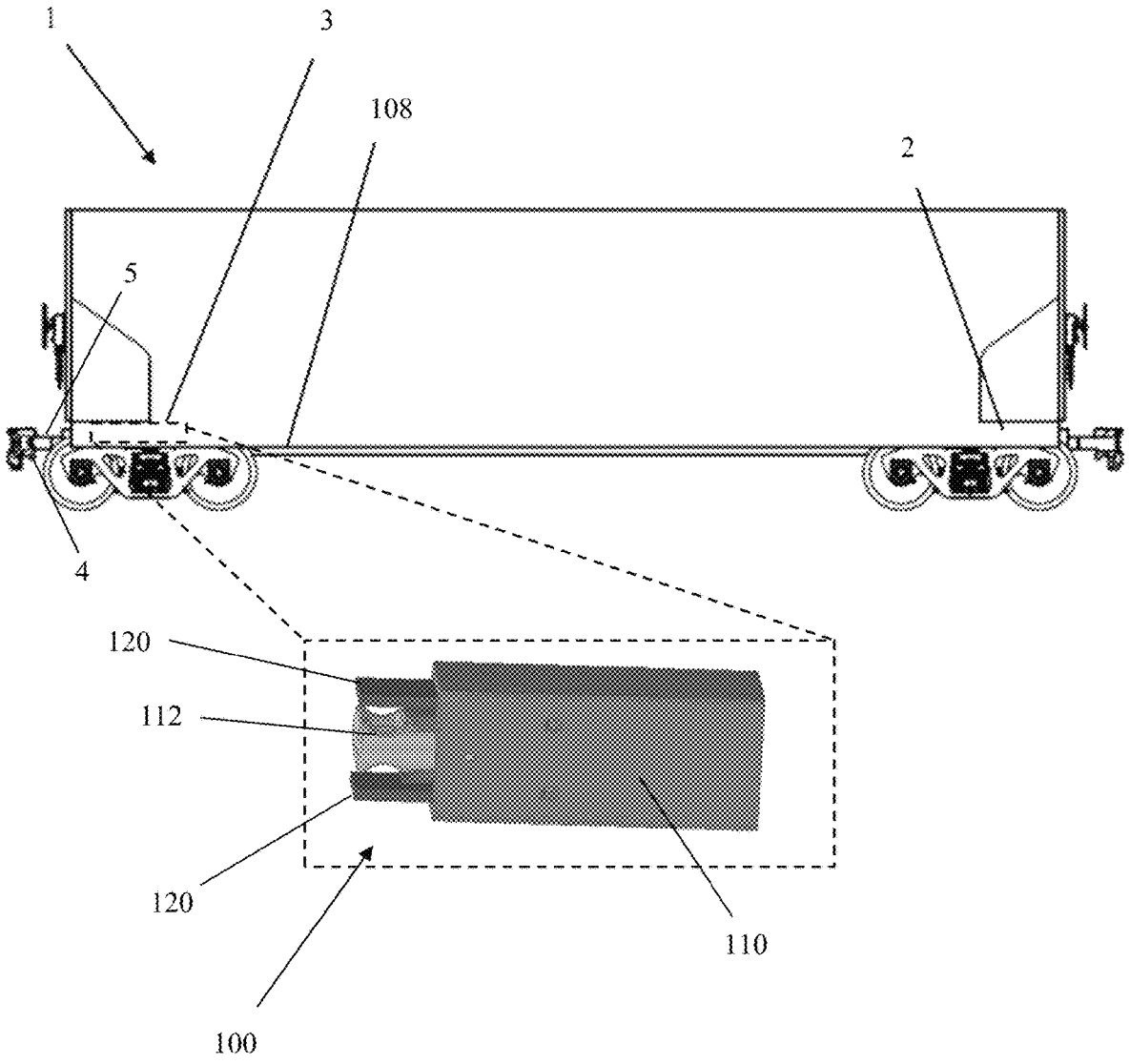
FIG. 1 shows an exemplary railcar and center sill pocket within which an embodiment of the damping system can be located.
Figure 2:
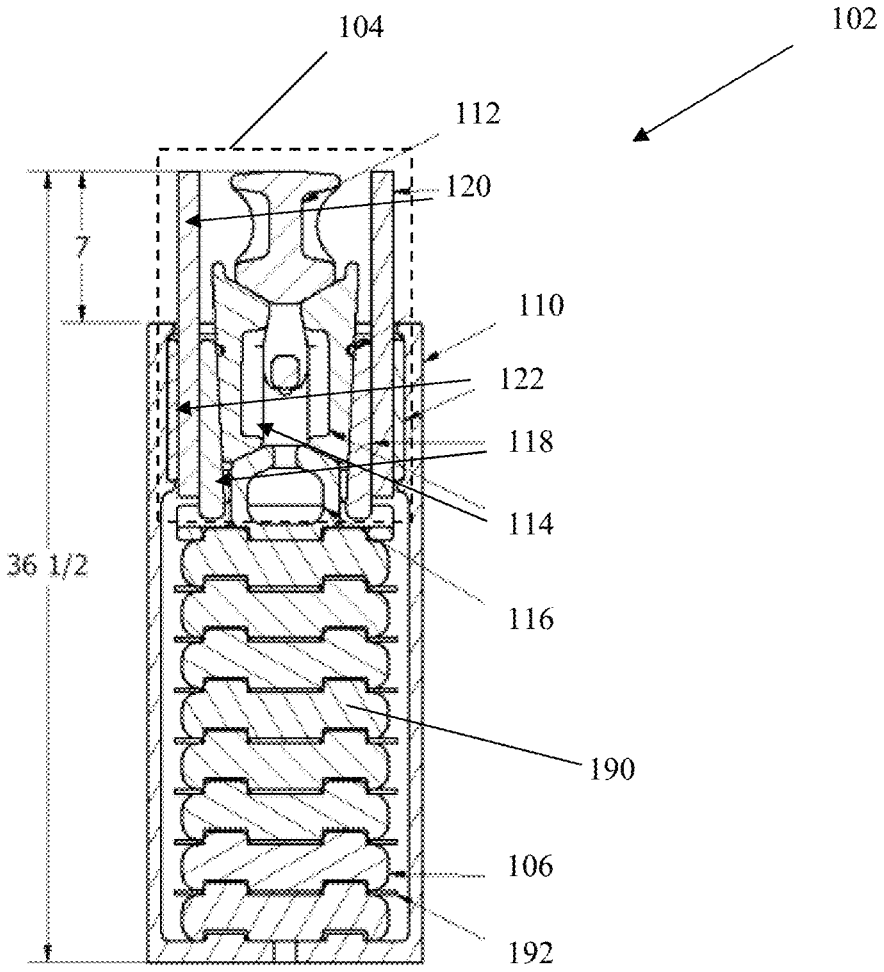
FIG. 2 shows a cross-sectional view of an embodiment of an extended travel draft gear.
Figure 3:
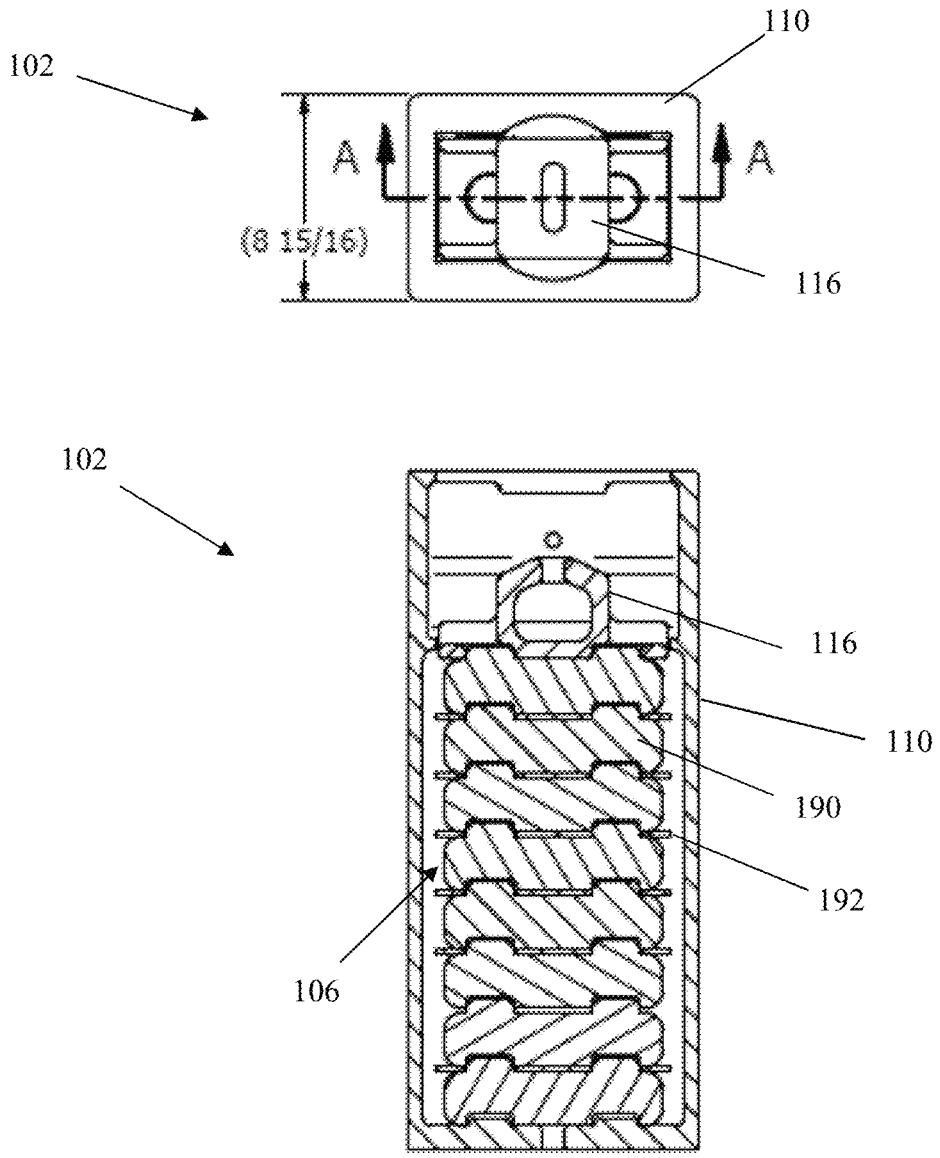
FIG. 3 shows a top view (top image) and a cross-sectional view (bottom image) of an embodiment of an extended travel draft gear without a clutch mechanism.
Figure 4:
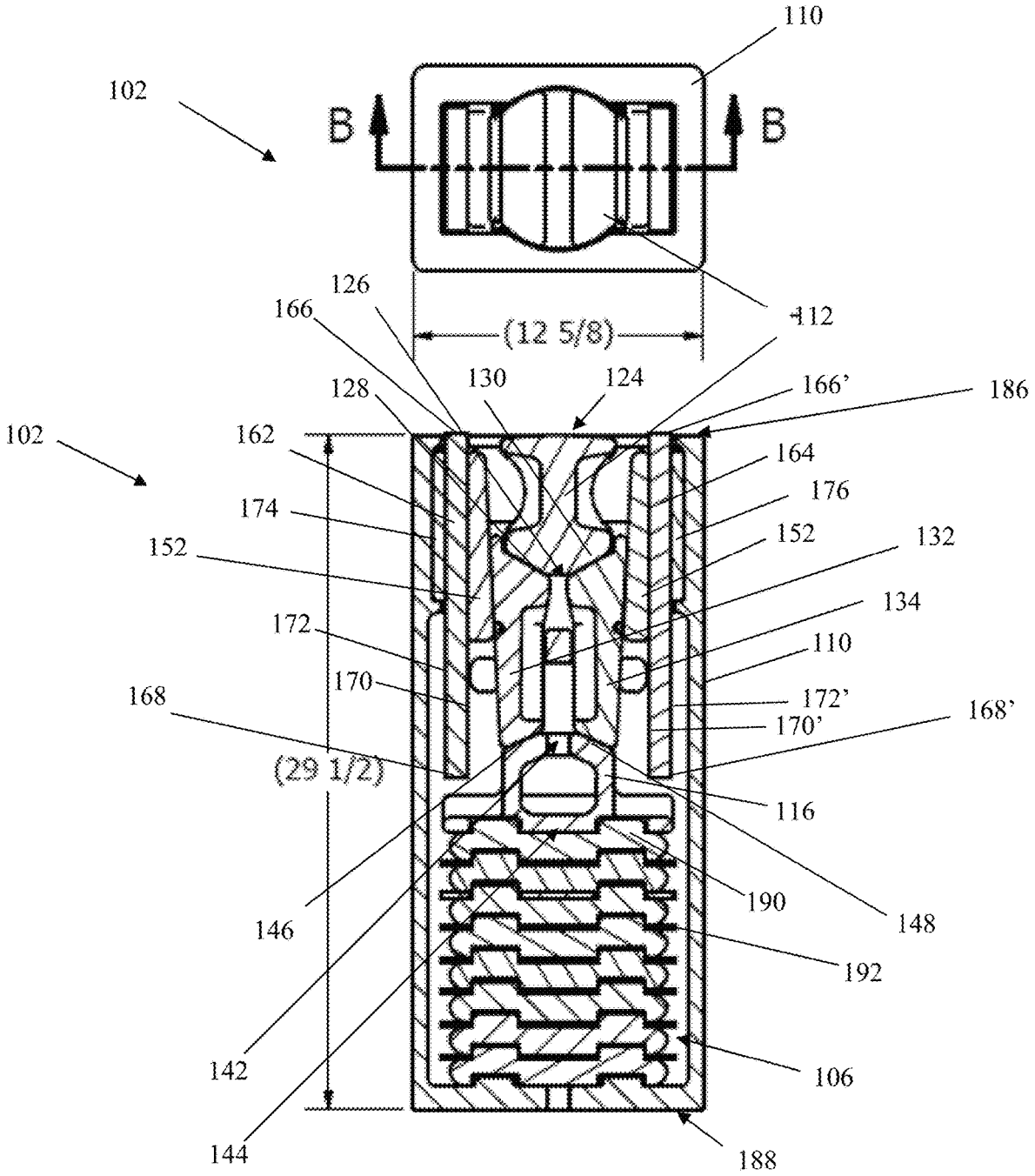
FIG. 4 shows a top view (top image) and a cross-sectional view (bottom image) of an embodiment of an extended travel draft gear with a clutch mechanism and with the extended travel draft gear in a fully compressed state.
Figure 5:
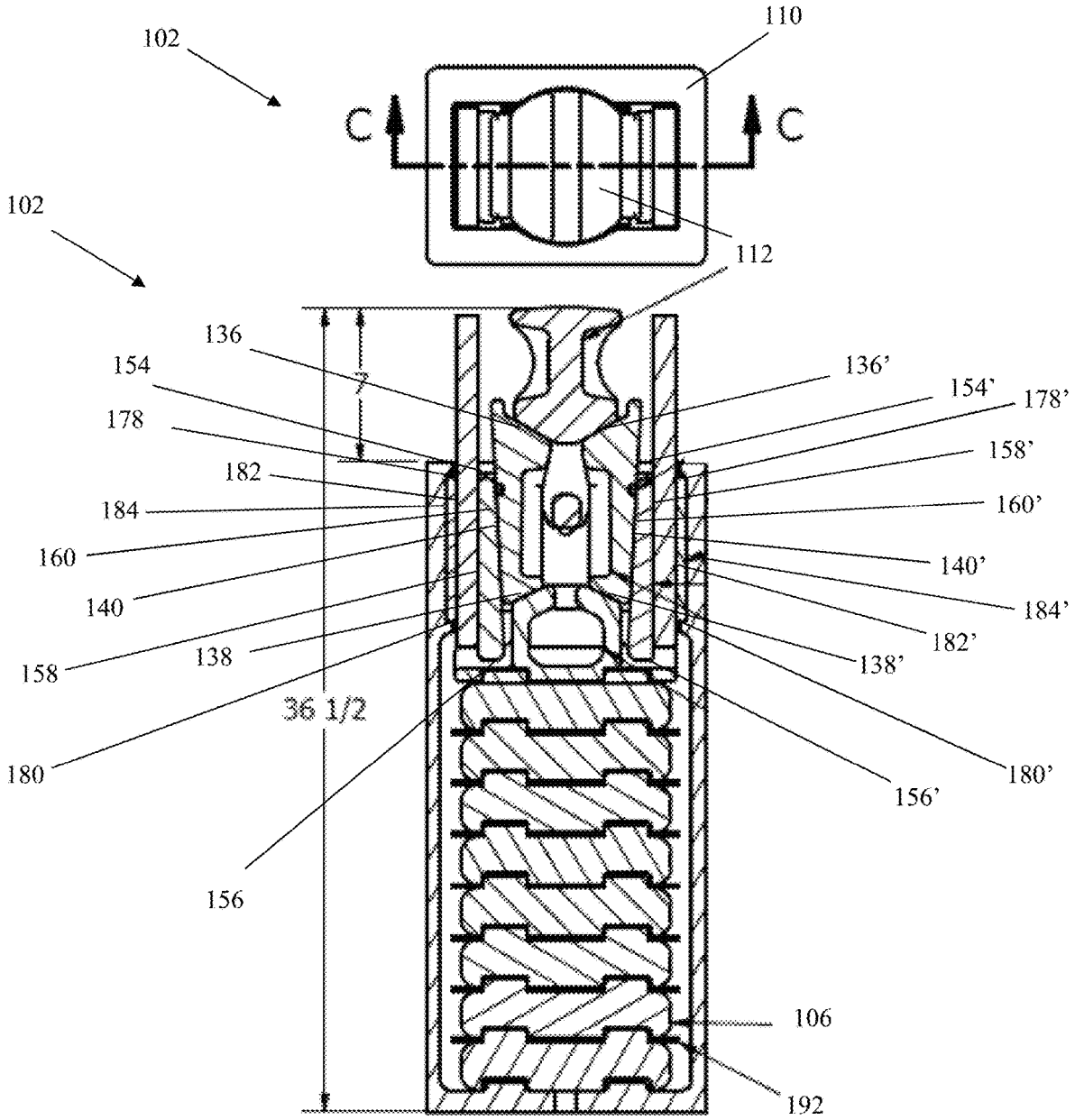
FIG. 5 shows a top view (top image) and a cross-sectional view (bottom image) of an embodiment of an extended travel draft gear with a clutch mechanism and with the extended travel draft gear in an uncompressed state.
Figure 6:
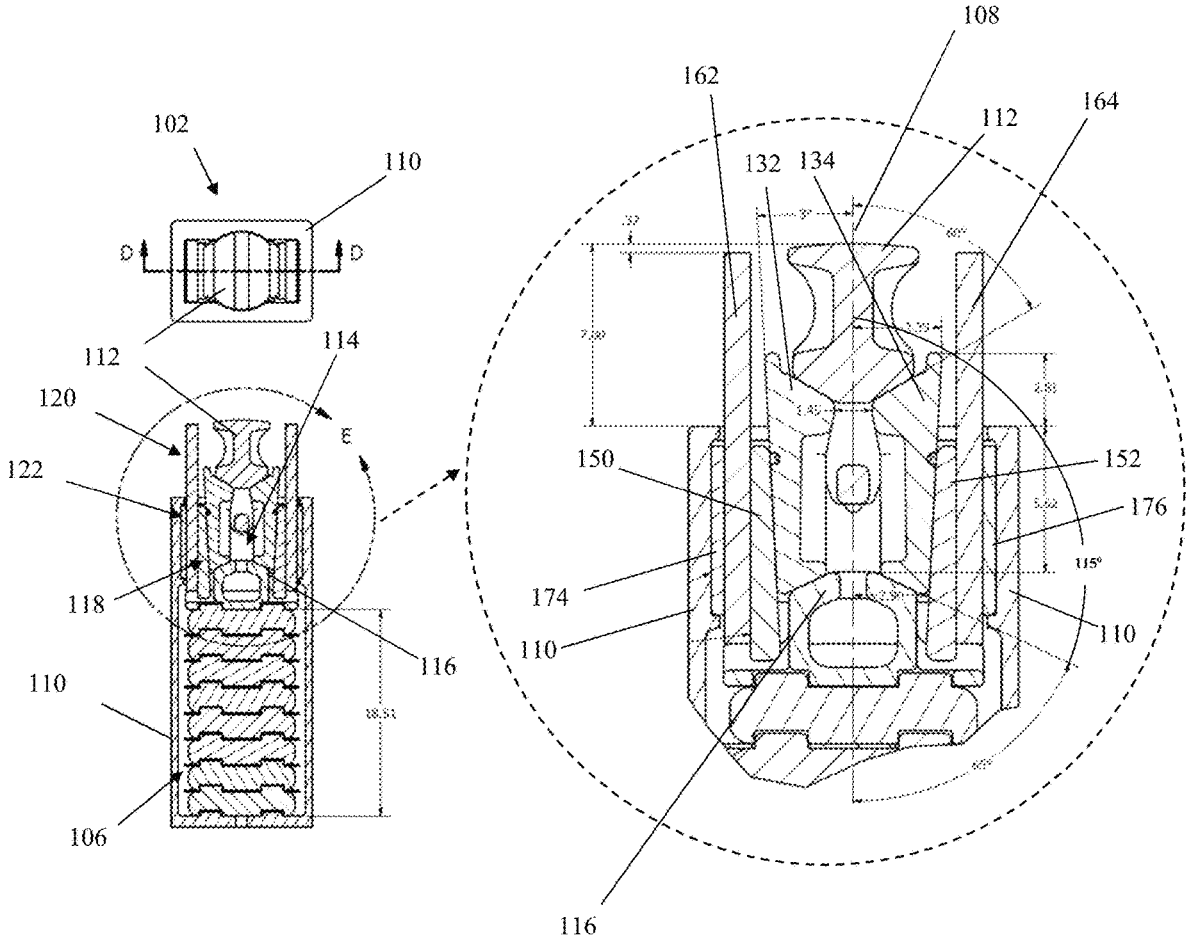
FIG. 6 shows a top view (top image) of an extended travel draft gear, a cross-sectional view (bottom-left image) of an extended travel draft gear, and an enlarged cross-sectional view (right image) of the clutch mechanism, wherein the extended travel draft gear is in an uncompressed state.
Figure 7:
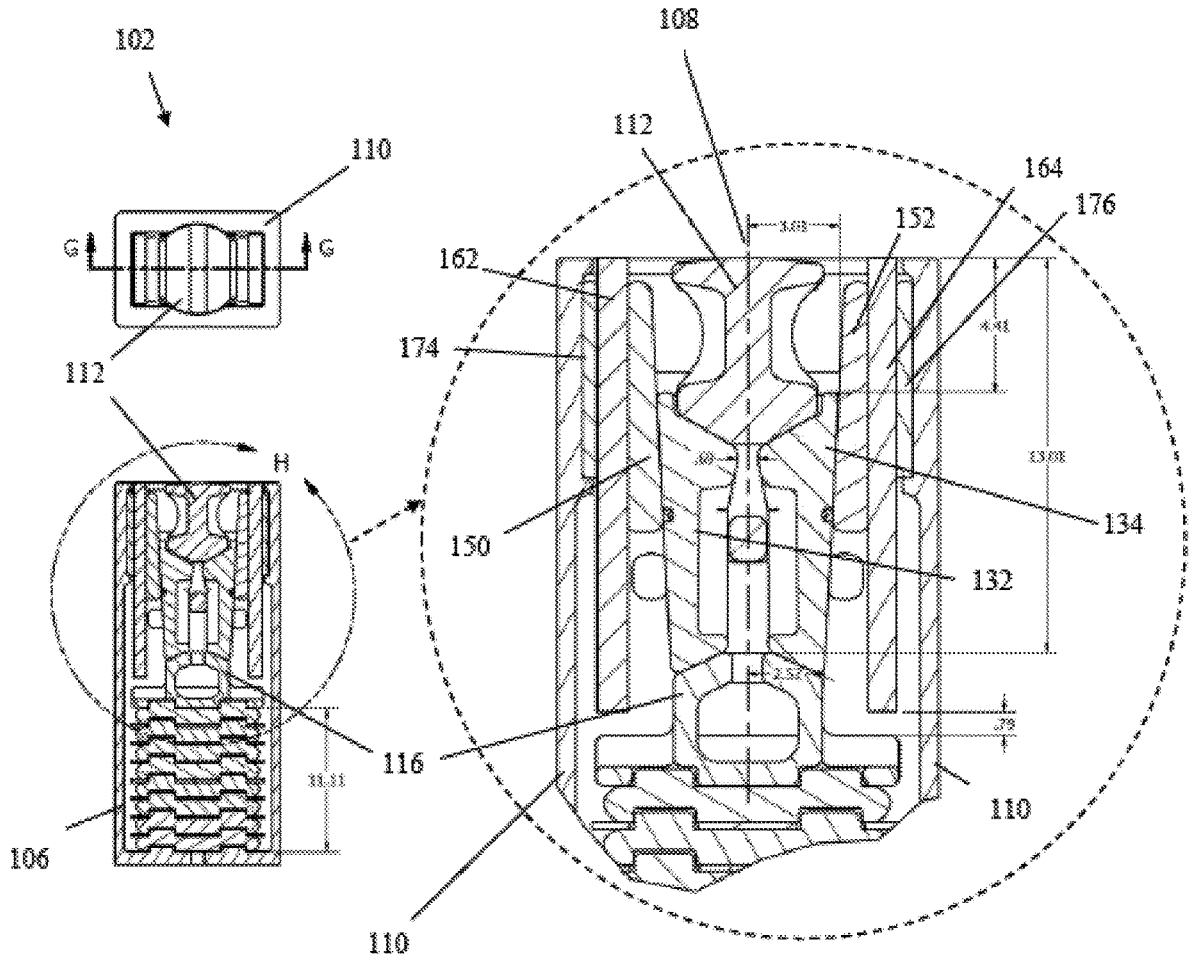
FIG. 7 shows a top view (top image) of an extended travel draft gear, a cross-sectional view (bottom-left image) of an extended travel draft gear, and an enlarged cross-sectional view (right image) of the clutch mechanism, wherein the extended travel draft gear is in a fully compressed state.
Figure 8:
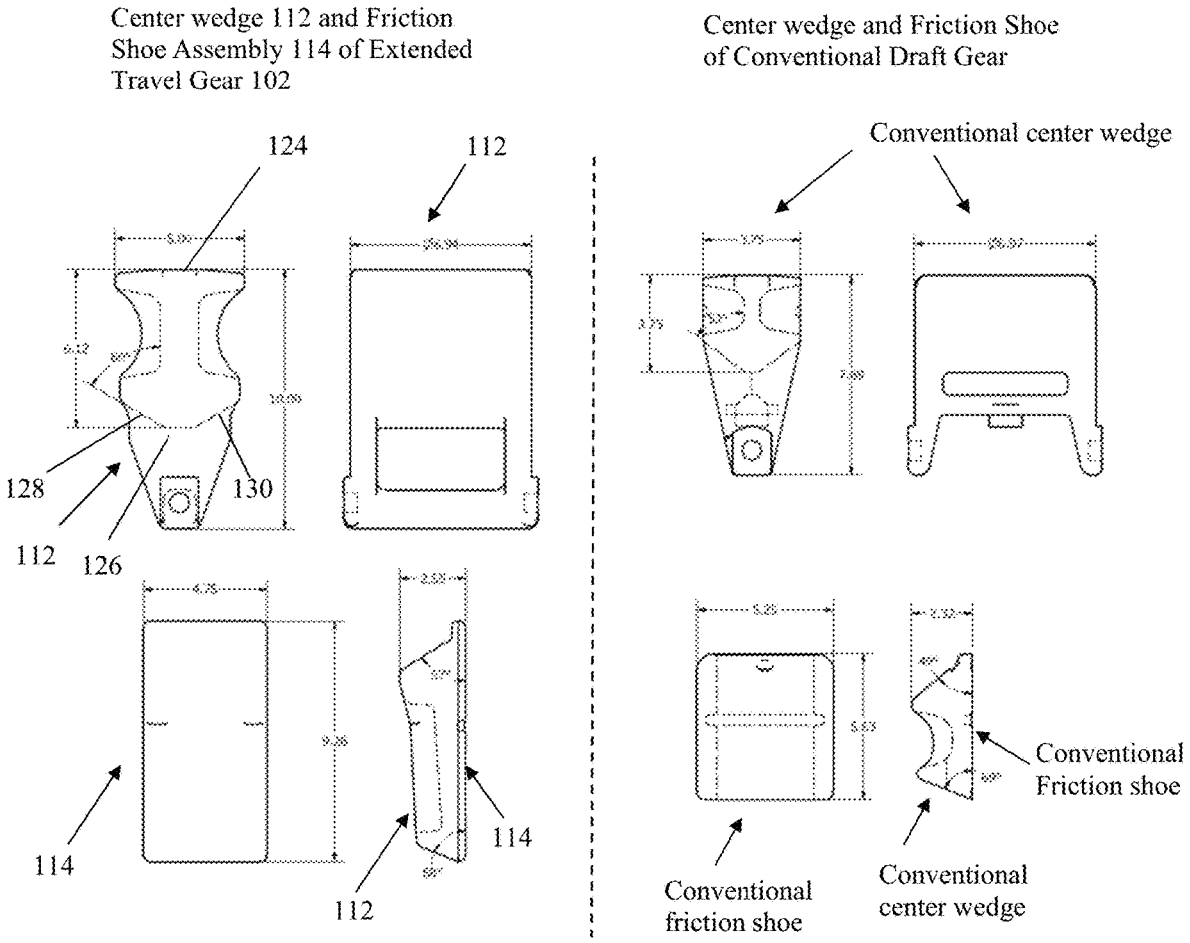
FIG. 8 shows a comparison of a center wedge and a friction shoe used for the extended travel draft gear (left) and a center wedge and a friction shoe used for a conventional draft gear (right).
Figure 9:
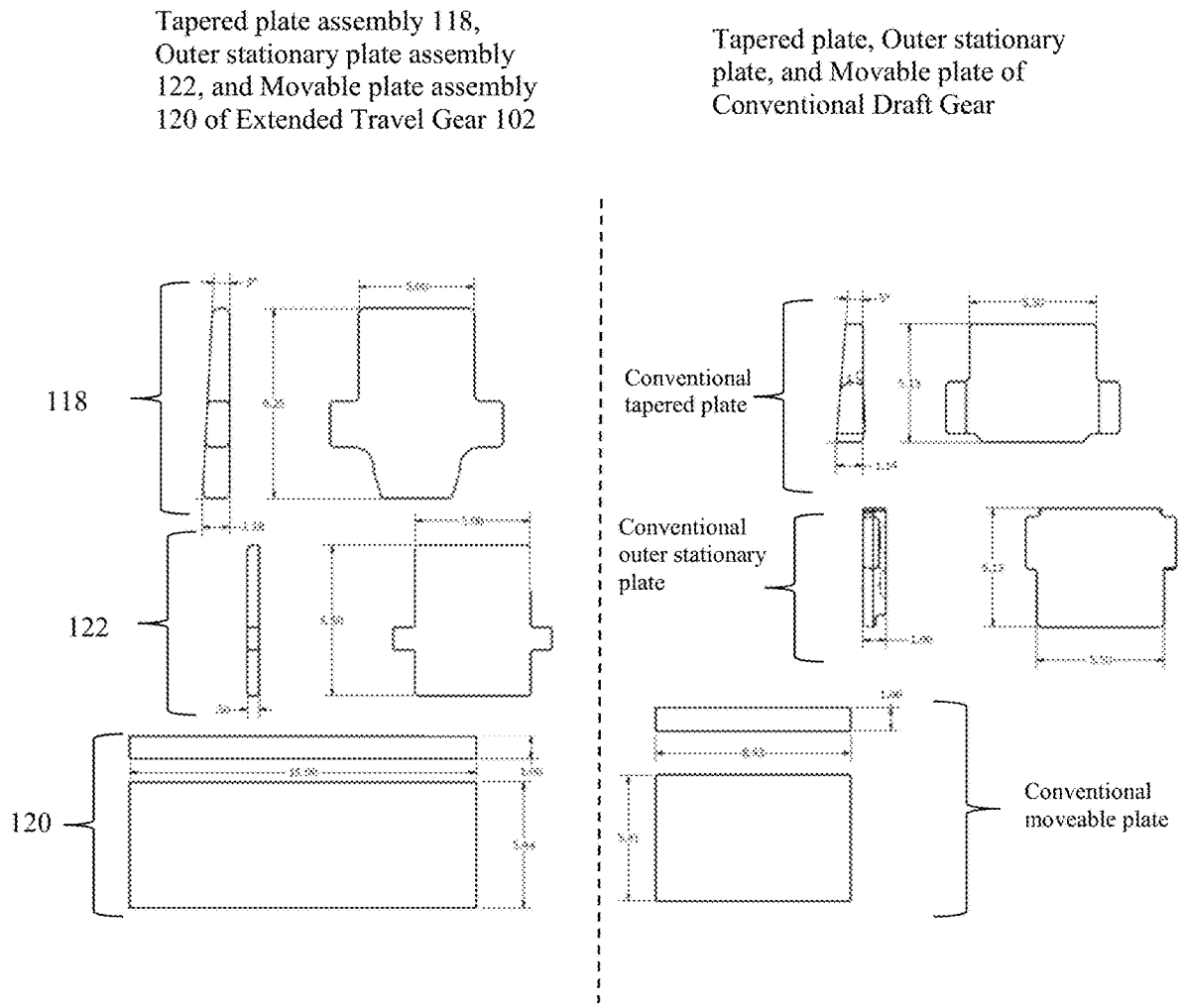
FIG. 9 shows a comparison of a tapered plate, a stationary plate, and a moveable plate used for the extended travel draft gear (left) and a tapered plate, a stationary plate, and a moveable plate used for a conventional draft gear (right).

Referring to FIG. 1, embodiments relate to a damping system 100 for a railcar 1, which includes an extended travel draft gear 102. The extended travel draft gear 102 includes a components (e.g., a clutch mechanism 104 and an elastomer pad assembly 106) to facilitate damped longitudinal movement along a longitudinal axis 108 of the extended travel draft gear 102. The extended travel draft gear 102 can also have a housing 110 and other components for desired or beneficial operation of the damping system 100.

The damping system 100 is secured to a railcar frame 2. For instance, the railcar frame 2 has a center sill pocket 3 within which the damping system 100 is secured. The center sill pocket 3 of the railcar frame 2 is located at or near a distal end of the railcar 1, and is a square or rectangular pocket that is sized to receive the damping system 100. In an exemplary embodiment, the center sill pocket 3 is rectangular and is configured to have its long axis be aligned (coaxial or parallel) with the longitudinal axis 108 of the railcar 1. The damping system 100 is placed within the center sill pocket 3 so that its rear end is more distal relative to the distal end of the railcar 1 than its front end is.

The center sill pocket 3 is sized to allow the damping system 100 to be inserted therein and have certain components be slid in a direction back and forth along the longitudinal axis 108 but is bounded in that longitudinal movement by stops or other mechanical means. The stops are attached to the frame 2 and form or define the center sill pocket 3 so that when the damping system 100 moves, one or more components of the damping system 100 abut against the stops to arrest further movement. Thus, the damping system 100 is intended to move within the center sill pocket 3, but the stops bound that movement to achieve the desired level of motion for the damping system 100.

A coupler 4 is mechanically connected to a yoke 5, each of which are rectangular or cylindrical members that is aligned with the longitudinal axis 108 of the railcar 1. The coupler 4 is configured to mechanically couple to another coupler via coupling impact. The yoke 5 is a member that sides within the center sill pocket 3 such that when the coupler 4 is impacted, the coupler 4 and the yoke 5 are both caused to move towards the damping system 100—this is a buff motion. The coupler 4 and yoke 5 both move relative to the damping system 100. Depending on the arrangement of the stops, compression of the damping system 100 may begin at this point. When the coupler 4 is pulled, the coupler 4 and the yoke 5 are both caused to move away from the damping system 100—this is draft motion. Depending on the arrangement of the stops, the damping system 100 is pulled along until it abuts a stop, causing a transfer of force to the railcar frame 2 and movement of the railcar. The buff and draft motions can be controlled via different configurations and placements of the stops and other components.

Referring to FIGS. 2-9, embodiments of the damping system 100 include a clutch mechanism 104. The clutch mechanism 104 has a center wedge 112, a friction shoe assembly 114, a spring seat 116, a tapered plate assembly 118, a moveable plate assembly 120, and an outer plate assembly 122.

The center wedge 112 has a wedge front end 124 and a wedge rear end 126 with a longitudinal axis 108 running from the wedge front end 124 to the wedge rear end 126. The wedge front end 124 is configured to mechanically engage the coupler 4. The wedge rear end 126 is configured to mechanically engage the friction shoe assembly 114. The wedge rear end 126 has a first wedge rear surface 128 that makes a 55-65° angle relative to the longitudinal axis 108 and a second wedge rear surface 130 that makes a 55-65° angle relative to the longitudinal axis 108.

The term "mechanically engage" between two components in this disclosure can refer to coupling to each other, abutting against each other, transferring forces to each other, etc.

The friction shoe assembly 114 includes a first shoe 132 configured to mechanically engage the first wedge rear surface 128 and a second shoe 134 configured to mechanically engage the second wedge rear surface 130.

The first shoe 132 has a front shoe surface 136, a rear shoe surface 138, and a side shoe surface 140. The front shoe surface 136 makes a 55-65° angle relative to the longitudinal axis 108 and is configured to mechanically engage the first wedge rear surface 128. The rear shoe surface 138 makes a 110-120° angle relative to the longitudinal axis 108 and is configured to mechanically engage with a spring seat 116. The side shoe surface 140 makes a 2-5° angle relative to the longitudinal axis 108 and is configured to mechanically engage with a tapered plate assembly 118.

The second shoe 134 has a front shoe surface 136', a rear shoe surface 138', and a side shoe surface 140'. The front shoe surface 136' makes a 55-65° angle relative to the longitudinal axis 108 and is configured to mechanically engage the second wedge rear surface 130. The rear shoe surface 138' makes a 110-120° angle relative to the longitudinal axis 108 and is configured to mechanically engage with a spring seat 116. The side shoe surface 140' makes a 2-5° angle relative to the longitudinal axis 108 and is configured to mechanically engage with the tapered plate assembly 118.

The spring seat 116 has a seat front end 142 and a seat rear end 144. The seat front end 142 has a first seat front surface 146 configured to mechanically engage the rear shoe surface 138 of the first shoe 132 and a second front seat surface 148 configured to mechanical mechanically engage the rear shoe surface 138 of the second shoe 134.

The tapered plate assembly 118 includes a first tapered plate 150 and a second tapered plate 152. The first tapered plate 150 has a tapered plate front end 154 and a tapered plate rear end 156 defining a length of 6-10 inches. The first tapered plate 150 has a straight side 158 and a tapered side 160. The tapered side 160 is configured to mechanically engage the side shoe surface 140 of the first shoe 132. The second tapered plate 152 has a tapered plate front end 154' and a tapered plate rear end 156' defining a length of 6-10 inches. The second tapered plate 152 has a straight side 158' and a tapered side 160'. The tapered side 160' is configured to mechanically engage the side shoe surface 140' of the second shoe 134.

The moveable plate assembly 120 includes a first moveable plate 162 and a second moveable plate 164. The first moveable plate 162 has a moveable plate front end 166 and a moveable plate rear end 168 defining a length of 12-18 inches. The first moveable plate 162 has a moveable plate inner side 170 and a moveable plate outer side 172. The moveable plate inner side 170 is configured to mechanically engage the straight side 158 of the first tapered plate 150. The second moveable plate 164 has a moveable plate front end 166' and a moveable plate rear end 168' defining a length of 12-18 inches. The second moveable plate 164 has a moveable plate inner side 170' and a moveable plate outer side 172'. The moveable plate inner side 170' is configured to mechanically engage the straight side 158' of the second tapered plate 152.

The outer plate assembly 122 includes a first outer plate 174 and a second outer plate 176. The first outer plate 174 has an outer plate front end 178 and an outer plate rear end 180 defining a length of 5.25-10 inches. The first outer plate 174 has an outer plate inner side 182 and an outer plate outer side 184. The outer plate inner side 182 is configured to mechanically engage the moveable plate outer side 172 of the first moveable plate 162. The second outer plate 176 has an outer plate front end 178' and an outer plate rear end 180' defining a length of 5.25-10 inches. The second outer plate 176 has an outer plate inner side 182' and an outer plate outer side 184'. The outer plate inner side 182' is configured to mechanically engage the moveable plate outer side 172' of the second moveable plate 164.

The extended travel draft gear 102 can have a housing 110. The housing 110 is a hollow member is configured to contain components (e.g., clutch mechanism 104 and/or other components) of the extended travel draft gear 102 in an interior cavity portion of the housing 110. In addition, the housing 110 is configured to hold both the tapered plate assembly 118 and the outer plate assembly 122 stationary relative to the housing 110. This can be achieved via a shelf formation in or on the housing 110, affixment (e.g., weld, fastener, etc.) of the tapered plate assembly 118 and the outer plate assembly 122 to the housing 110, or other type of stop mechanism.

The housing 110 has a housing front end 186 and a housing rear end 188. The clutch mechanism 104 is configured to transition between a fully compressed state and a fully uncompressed state. In the fully compressed state, each moveable plate front end 166 is flush with the housing front end 186. In the fully uncompressed state, each moveable plate front end 166 extends 5-8 inches beyond the housing front end. During transitioning from the fully uncompressed state towards a fully compressed state: the center wedge 112 engages the friction shoe assembly 114; the friction shoe assembly 114 engages the spring seat 116 and the tapered plate assembly 118; and the moveable plate assembly 120 engages the tapered plate assembly 118 and the outer plate assembly 122. Movement of the center wedge 112, the friction shoe assembly 114, and the moveable plate assembly 120 relative to the tapered plate assembly 118 and the outer plate assembly 122 transforms kinetic energy into thermal energy via friction, wherein motion along the longitudinal axis 108 is damped via energy dissipation.

The above describes the clutch mechanism 104. It is contemplated for the inventive clutch mechanism 104 to be used as a component of the draft gear to form an extended travel draft gear 102. Thus, the inventive damping system 100 can be the clutch mechanism 104 itself (to be used in a draft gear) or be draft gear 102 that has clutch mechanism 104 so as to form an extended travel draft gear 102.

Embodiments of the extended travel draft gear 102 include a housing 110 having an open housing front end 186 and a closed housing rear end 188. The extended travel draft gear 102 has a clutch mechanism 104 located within the housing front end 186. The clutch mechanism 104 has a center wedge 112, a friction shoe assembly 114, a spring seat 116, a tapered plate assembly 118, a moveable plate assembly 120, and an outer plate assembly 122.

The clutch mechanism 104 includes a center wedge 112 having a wedge front end 124 and a wedge rear end 126 with a longitudinal axis 108 running from the wedge front end 124 to the wedge rear end 126. The wedge front end 124 is configured to mechanically engage a coupler 4. The wedge rear end 126 is configured to mechanically engage a friction shoe assembly 114. The wedge rear end 126 has a first wedge rear surface 128 that makes a 55-65° angle relative to the longitudinal axis 108 and a second wedge rear surface 130 that makes a 55-angle relative to the longitudinal axis 108.

The friction shoe assembly 114 has a first shoe 132 configured to mechanically engage the first wedge rear surface 128 and a second shoe 134 configured to mechanically engage the second wedge rear surface 130. The first shoe 132 has a front shoe surface 136, a rear shoe surface 138, and a side shoe surface 140. The front shoe surface 136 makes a 55-65° angle relative to the longitudinal axis 108 and is configured to mechanically engage the first wedge rear surface 128. The rear shoe surface 138 makes a 55-65° angle relative to the longitudinal axis 108 and is configured to mechanically engage with a spring seat 116. The side shoe surface 140 makes a 2-5° angle relative to the longitudinal axis 108 and is configured to mechanically engage with a tapered plate assembly 118. The second shoe 134 has a front shoe surface 136', a rear shoe surface 138', and a side shoe surface 140', the front shoe surface 136' makes a 55-65° angle relative to the longitudinal axis 108 and is configured to mechanically engage the second wedge rear surface 130. The rear shoe surface 138' makes a 110-120° angle relative to the longitudinal axis 108 and is configured to mechanically engage with a spring seat 116. The side shoe surface 140' makes a 2-5° angle relative to the longitudinal axis 108 and is configured to mechanically engage with the tapered plate assembly 118.

The spring seat 116 has a seat front end 142 and a seat rear end 144. The seat front end 142 has a first seat front surface 146 configured to mechanically engage the rear shoe surface 138 of the first shoe 132 and a second front seat surface 148 configured to mechanically engage the rear shoe surface 138 of the second shoe 134. The seat rear end 144 is configured to mechanically engage an elastomer pad assembly 106.

The tapered plate assembly 118 includes a first tapered plate 150 and a second tapered plate 152. The first tapered plate 150 has a tapered plate front end 154 and a tapered plate rear end 156 defining a length of 6-10 inches. The first tapered plate 150 has a straight side 158 and a tapered side 160. The tapered side 160 is configured to mechanically engage the side shoe surface 140 of the first shoe 132. The second tapered plate 152 has a tapered plate front end 154' and a tapered plate rear end 156' defining a length of 6-10 inches. The second tapered plate 152 has a straight side 158' and a tapered side 160'. The tapered side 160' is configured to mechanically engage the side shoe surface 140' of the second shoe 134.

The moveable plate assembly 120 includes a first moveable plate 162 and a second moveable plate 164. The first moveable plate 162 has a moveable plate front end 166 and a moveable plate rear end 168 defining a length of 12-18 inches. The first moveable plate 162 has a moveable plate inner side 170 and a moveable plate outer side 172. The moveable plate inner side 170 is configured to mechanically engage the straight side 158 of the first tapered plate 150. The second moveable plate 164 has a moveable plate front end 166' and a moveable plate rear end 168' defining a length of 12-18 inches. The second moveable plate 164 has a moveable plate inner side 170' and a moveable plate outer side 172'. The moveable plate inner side 170' is configured to mechanically engage the straight side 158' of the second tapered plate 152.

The outer plate assembly 122 includes a first outer plate 174 and a second outer plate 176. The first outer plate 174 has an outer plate front end 178 and an outer plate rear end 180 defining a length of 5.25-10 inches. The first outer plate 174 has an outer plate inner side 182 and an outer plate outer side 184. The outer plate inner side 182 is configured to mechanically engage the moveable plate outer side 172 of the first moveable plate 162. The second outer plate 176 has an outer plate front end 178' and an outer plate rear end 180' defining a length of 5.25-10 inches. The second outer plate 176 has an outer plate inner side 182' and an outer plate outer side 184'. The outer plate inner side 182' is configured to mechanically engage the moveable plate outer side 172' of the second moveable plate 164.

The elastomer pad assembly 106 includes a plurality of elastomer pads 190 arranged within the housing rear end 188. These can be arranges in a serial manner. There can be a pad shim 192 disposed between any two adjacent elastomer pads 190. It is understood that the elastomer pad assembly 106 can be a spring assembly having springs (or any other type of element that non-plastically deforms when acted upon) as opposed to elastomer pads, or be an assembly having both elastomer pads and springs. There can be any number or configuration of pads or springs.

Figure 10:
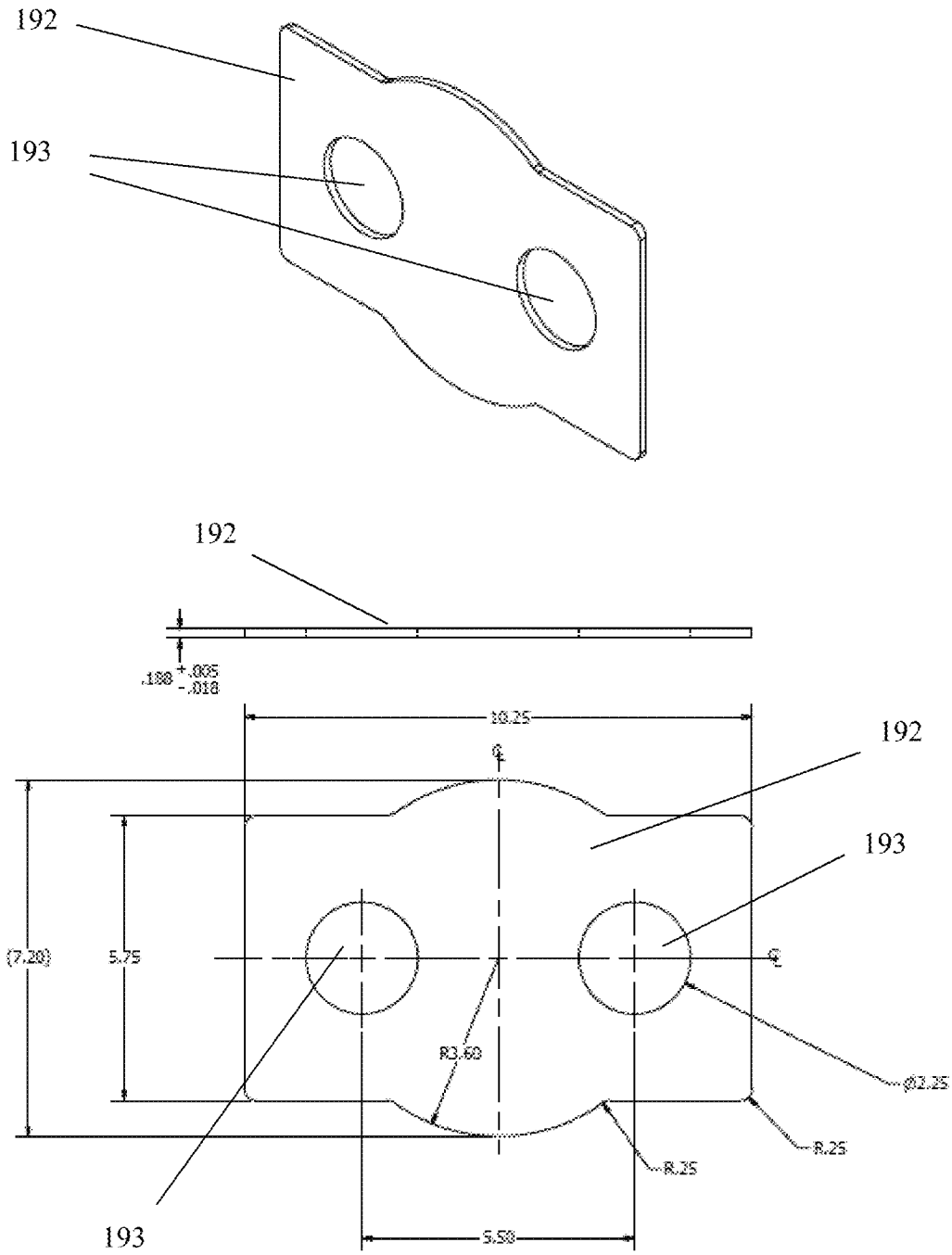
FIG. 10 shows an exemplary pad shim that may be used with embodiments of the damping system, illustrating a perspective view (top), side view (middle), and front view (bottom) of the exemplary pad shim.

FIG. 10 shows an exemplary pad shim 192. It is contemplated for the pad shim 192 to be a planar member and also have a profile that matches or complements the profile of the elastomer pad 190. The exemplary pad shim 192 shown in FIG. 10 has a profile shape that is rectangular with an arcuate formation in a central portion of the long legs of the rectangle. Each pad shim 192 can have at least one aperture 193 formed therein to facilitate interconnection of the pads 190 when stacked in a serial manner.

The tapered plate assembly 118 and the outer plate assembly 122 are secured to the housing 110 such that each is held stationary relative to the housing 110. This can be achieved via a shelf formation in or on the housing 110, affixment (e.g., weld, fastener, etc.) of the tapered plate assembly 118 and the outer plate assembly 122 to the housing 110, or other type of stop mechanism.

The extended travel draft gear 102 is configured to transition between a fully compressed state and a fully uncompressed state. In the fully compressed state, each moveable plate front end 166, 166' is flush with the housing front end 186. In the fully uncompressed state, each moveable plate front end 166, 166' extends 5-8 inches beyond the housing front end 186. During transitioning from the fully uncompressed state towards a fully compressed state: the center wedge 112 engages the friction shoe assembly 114; the friction shoe assembly 114 engages the spring seat 116 and the tapered plate assembly 118; the moveable plate assembly 120 engages the tapered plate assembly 118 and the outer plate assembly 122. Movement of the center wedge 112, the friction shoe assembly 114, and the moveable plate assembly 120 relative to the tapered plate assembly 118 and the outer plate assembly 122 transforms kinetic energy into thermal energy via friction, wherein motion along the longitudinal axis 108 is damped via energy dissipation. During transitioning from the fully uncompressed state towards a fully compressed state, the seat rear end 144 mechanically engages the elastomer pad assembly 106 to cause the elastomer pad assembly 106 to compress.

Embodiments relate to a method of damping motion within a railcar draft gear. The railcar draft gear can include an embodiment of the clutch mechanism 104 or be configured as an extended travel draft gear 102—i.e., the railcar draft hear can include a center wedge 112, a friction shoe assembly 114, a moveable plate assembly 120, a tapered plate assembly 118, an outer plate assembly 122, a spring seat 116, and an elastomer pad assembly 106. The method involves allowing movement of the center wedge 112, the friction shoe assembly 114, and the moveable plate assembly 120 relative to the tapered plate assembly 118 and the outer plate assembly 122 to transform kinetic energy into thermal energy via friction such that motion along a longitudinal axis 108 of the clutch mechanism 104 is damped via energy dissipation by 5-9 inches of movement.

It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. For instance, it is contemplated that a particular feature described, either individually or as part of an embodiment, can be combined with other individually described features, or parts of other embodiments. The elements and acts of the various embodiments described herein can therefore be combined to provide further embodiments.

It is further understood that there can be any number of components used for a damping system 100, draft gear 102, or clutch mechanism 104. For instance, a damping system 100 may include more than one draft gear 102, a draft gear 102 may include more than one clutch mechanism 104, a clutch mechanism 104 may include any number of moveable plates 120, tapered plats 118, etc. to meet a desired design criterion.

It is the intent to cover all such modifications and alternative embodiments as may come within the true scope of this invention, which is to be given the full breadth thereof. Additionally, the disclosure of a range of values is a disclosure of every numerical value within that range, including the end points. Thus, while certain exemplary embodiments of the system, device, and methods of making and using the same have been discussed and illustrated herein, it is to be distinctly understood that the invention is not limited thereto but may be otherwise variously embodied and practiced within the scope of the following claims.

What is claimed is:

1. A clutch mechanism for a railcar draft gear, the clutch mechanism comprising:

a center wedge having a wedge front end and a wedge rear end with a longitudinal axis running from the wedge front end to the wedge rear end, the wedge front end configured to mechanically engage a coupler, the wedge rear end configured to mechanically engage a friction shoe assembly, the wedge rear end having a first wedge rear surface that makes a 55-65° angle relative to the longitudinal axis and a second wedge rear surface that makes a 55-65° angle relative to the longitudinal axis;

the friction shoe assembly, comprising a first shoe configured to mechanically engage the first wedge rear surface and a second shoe configured to mechanically engage the second wedge rear surface, wherein:

the first shoe has a front shoe surface, a rear shoe surface, and a side shoe surface, the front shoe surface making a 55-65° angle relative to the longitudinal axis and is configured to mechanically engage the first wedge rear surface, the rear shoe surface making a 110-120° angle relative to the longitudinal axis and is configured to mechanically engage with a spring seat, the side shoe surface making a 2-5° angle relative to the longitudinal axis and is configured to mechanically engage with a tapered plate assembly; and the second shoe has a front shoe surface, a rear shoe surface, and a side shoe surface, the front shoe surface making a 55-65° angle relative to the longitudinal axis and is configured to mechanically engage the second wedge rear surface, the rear shoe surface making a 110-120° angle relative to the longitudinal axis and is configured to mechanically engage with a spring seat, the side shoe surface making a 2-5° angle relative to the longitudinal axis and is configured to mechanically engage with the tapered plate assembly;

the spring seat having a seat front end and a seat rear end, the seat front end having a first seat front surface configured to mechanically engage the rear shoe surface of the first shoe and a second front seat surface configured to mechanically engage the rear shoe surface of the second shoe;

the tapered plate assembly, comprising:

a first tapered plate having a tapered plate front end and a tapered plate rear end defining a length of 6-10 inches, the first tapered plate having a straight side and a tapered side, the tapered side configured to mechanically engage the side shoe surface of the first shoe; and a second tapered plate having a tapered plate front end and a tapered plate rear end defining a length of 6-10 inches, the second tapered plate having a straight side and a tapered side, the tapered side configured to mechanically engage the side shoe surface of the second shoe;

a moveable plate assembly, comprising:

a first moveable plate having a moveable plate front end and a moveable plate rear end defining a length of 12-18 inches, the first moveable plate having a moveable plate inner side and a moveable plate outer side, the moveable plate inner side configured to mechanically engage the straight side of the first tapered plate; and a second moveable plate having a moveable plate front end and a moveable plate rear end defining a length of 12-18 inches, the second moveable plate having a moveable plate inner side and a moveable plate outer side, the moveable plate inner side configured to mechanically engage the straight side of the second tapered plate; and an outer plate assembly, comprising:

a first outer plate having an outer plate front end and an outer plate rear end defining a length of 5.25-10 inches, the first outer plate having an outer plate inner side and an outer plate outer side, the outer plate inner side configured to mechanically engage the moveable plate outer side of the first moveable plate; and a second outer plate having an outer plate front end and an outer plate rear end defining a length of 5.25-10 inches, the second outer plate having an outer plate inner side and an outer plate outer side, the outer plate inner side configured to mechanically engage the moveable plate outer side of the second moveable plate.

2. The clutch mechanism of claim 1, further comprising:

a housing configured to hold both the tapered plate assembly and the outer plate assembly stationary relative to the housing.

3. The clutch mechanism of claim 2, wherein:

the housing has a housing front end and a housing rear end;

the clutch mechanism is configured to transition between a fully compressed state and a fully uncompressed state;

in the fully compressed state, each moveable plate front end is flush with the housing front end; and in the fully uncompressed state, each moveable plate front end extends 5-8 inches beyond the housing front end.

4. The clutch mechanism of claim 3, wherein:

during transitioning from the fully uncompressed state towards a fully compressed state:

the center wedge engages the friction shoe assembly;

the friction shoe assembly engages the spring seat and the tapered plate assembly;

the moveable plate assembly engages the tapered plate assembly and the outer plate assembly; and movement of the center wedge, the friction shoe assembly, and the moveable plate assembly relative to the tapered plate assembly and the outer plate assembly transforms kinetic energy into thermal energy via friction, wherein motion along the longitudinal axis is damped via energy dissipation.

5. A method of damping motion within a railcar draft gear comprising the clutch mechanism of claim 1, the method comprising:

allowing movement of the center wedge, the friction shoe assembly, and the moveable plate assembly relative to the tapered plate assembly and the outer plate assembly to transform kinetic energy into thermal energy via friction such that motion along the longitudinal axis is damped via energy dissipation by 5-9 inches of movement.

6. A railcar draft gear, comprising:

a housing having an open housing front end and a closed housing rear end;

a clutch mechanism located within the housing front end, the clutch mechanism comprising:

a center wedge having a wedge front end and a wedge rear end with a longitudinal axis running from the wedge front end to the wedge rear end, the wedge front end configured to mechanically engage a coupler, the wedge rear end configured to mechanically engage a friction shoe assembly, the wedge rear end having a first wedge rear surface that makes a 55-65° angle relative to the longitudinal axis and a second wedge rear surface that makes a 55-65° angle relative to the longitudinal axis;

the friction shoe assembly, comprising a first shoe configured to mechanically engage the first wedge rear surface and a second shoe configured to mechanically engage the second wedge rear surface, wherein:

the first shoe has a front shoe surface, a rear shoe surface, and a side shoe surface, the front shoe surface making a 55-65° angle relative to the longitudinal axis and is configured to mechanically engage the first wedge rear surface, the rear shoe surface making a 110-120° angle relative to the longitudinal axis and is configured to mechanically engage with a spring seat, the side shoe surface making a 2-5° angle relative to the longitudinal axis and is configured to mechanically engage with a tapered plate assembly; and the second shoe has a front shoe surface, a rear shoe surface, and a side shoe surface, the front shoe surface making a 55-65° angle relative to the longitudinal axis and is configured to mechanically engage the second wedge rear surface, the rear shoe surface making a 110-120° angle relative to the longitudinal axis and is configured to mechanically engage with a spring seat, the side shoe surface making a 2-5° angle relative to the longitudinal axis and is configured to mechanically engage with the tapered plate assembly;

the spring seat having a seat front end and a seat rear end, the seat front end having a first seat front surface configured to mechanically engage the rear shoe surface of the first shoe and a second front seat surface configured to mechanically engage the rear shoe surface of the second shoe, the seat rear end configured to mechanically engage an elastomer pad assembly;

the tapered plate assembly, comprising:

a first tapered plate having a tapered plate front end and a tapered plate rear end defining a length of 6-10 inches, the first tapered plate having a straight side and a tapered side, the tapered side configured to mechanically engage the side shoe surface of the first shoe; and a second tapered plate having a tapered plate front end and a tapered plate rear end defining a length of 6-10 inches, the second tapered plate having a straight side and a tapered side, the tapered side configured to mechanically engage the side shoe surface of the second shoe;

a moveable plate assembly, comprising:

a first moveable plate having a moveable plate front end and a moveable plate rear end defining a length of 12-18 inches, the first moveable plate having a moveable plate inner side and a moveable plate outer side, the moveable plate inner side configured to mechanically engage the straight side of the first tapered plate; and a second moveable plate having a moveable plate front end and a moveable plate rear end defining a length of 12-18 inches, the second moveable plate having a moveable plate inner side and a moveable plate outer side, the moveable plate inner side configured to mechanically engage the straight side of the second tapered plate; and an outer plate assembly, comprising:

a first outer plate having an outer plate front end and an outer plate rear end defining a length of 5.25-10 inches, the first outer plate having an outer plate inner side and an outer plate outer side, the outer plate inner side configured to mechanically engage the moveable plate outer side of the first moveable plate;

a second outer plate having an outer plate front end and an outer plate rear end defining a length of 5.25-10 inches, the second outer plate having an outer plate inner side and an outer plate outer side, the outer plate inner side configured to mechanically engage the moveable plate outer side of the second moveable plate; and the elastomer pad assembly, comprising a plurality of elastomer pads arranged within the housing rear end.

7. The railcar draft gear of claim 6, wherein:

the tapered plate assembly and the outer plate assembly are secured to the housing such that each is held stationary relative to the housing.

8. The railcar draft gear of claim 6, wherein:

the draft gear is configured to transition between a fully compressed state and a fully uncompressed state;

in the fully compressed state, each moveable plate front end is flush with the housing front end; and in the fully uncompressed state, each moveable plate front end extends 5-8 inches beyond the housing front end.

9. The railcar draft gear of claim 8, wherein:

during transitioning from the fully uncompressed state towards a fully compressed state:

the center wedge engages the friction shoe assembly;

the friction shoe assembly engages the spring seat and the tapered plate assembly;

the moveable plate assembly engages the tapered plate assembly and the outer plate assembly; and movement of the center wedge, the friction shoe assembly, and the moveable plate assembly relative to the tapered plate assembly and the outer plate assembly transforms kinetic energy into thermal energy via friction, wherein motion along the longitudinal axis is damped via energy dissipation.

10. The railcar draft gear of claim 9, wherein:

during transitioning from the fully uncompressed state towards a fully compressed state, the seat rear end mechanically engages the elastomer pad assembly to cause the elastomer pad assembly to compress.

11. The railcar draft gear of claim 6, wherein:

the elastomer pad assembly includes a pad shim disposed between two elastomer pads.

* * * * *